US005332516A

United States Patent [19]

Stephens

[11] Patent Number: 5,332,516

[45] Date of Patent: Jul. 26, 1994

[54] FRICTION REDUCING COMPOSITION AND LUBRICANT FOR MOTORS

[76] Inventor: James C. Stephens, 495 Kurtz Rd., NE., Marietta, Ga. 30066

[21] Appl. No.: 874,008

[22] Filed: Apr. 27, 1992

[51] Int. Cl.[5] ..... C10M 131/04; C10M 131/14

[52] U.S. Cl. ..... 252/54; 252/57; 252/58

[58] Field of Search ..... 252/58, 54, 57

[56] References Cited

U.S. PATENT DOCUMENTS

| | | | |
|---|---|---|---|
| 3,149,077 | 9/1964 | Davis | 252/58 |
| 3,352,780 | 11/1967 | Groslambert | 252/58 |
| 4,504,404 | 3/1985 | Schumacher et al. | 252/58 |
| 4,534,873 | 8/1985 | Clarke | 252/32.7 |
| 4,844,825 | 7/1989 | Sloan | 252/40.7 |
| 4,965,002 | 10/1990 | Branner et al. | 252/32.5 |

FOREIGN PATENT DOCUMENTS

| | | | |
|---|---|---|---|
| 1413105 | 11/1975 | United Kingdom | C10M 3/40 |

OTHER PUBLICATIONS

Smaller et al "Lubricant Additives"; 1967 pp. 6-7.

*Primary Examiner*—Jacqueline V. Howard
*Attorney, Agent, or Firm*—Deveau, Colton & Marquis

[57] ABSTRACT

A friction reducing compound composed of a chlorinated paraffin, a rust-inhibiting compound, and an optional antimicrobial compound, and a lubricant comprising the friction reducing composition blended with a conventional lubricant.

12 Claims, 4 Drawing Sheets

FRICTION REDUCING COMPOSITION AND LUBRICANT FOR MOTORS

BACKGROUND OF THE INVENTION

1. Field of the Invention

The present invention is directed to a new friction reducing composition and a lubricant comprising this new friction reducing composition which is useful in motors of all classes. More specifically, the present invention is directed to a friction reducing composition comprising chlorinated paraffins, rust inhibiting compounds and optional antimicrobial compounds which, alone or combined with a conventional lubricant, such as oil, grease or silicone, can be added directly to a motor to reduce friction and wear and to improve the efficiency of the motor.

2. Description of the Prior Art

Chlorinated paraffins have been used extensively in the metal working industry as extreme pressure additives for lubricating oils since the early 1930's. Typical commercial chlorinated paraffins comprise chlorine and a petroleum fraction, such as normal paraffins, and generally have approximately 20–70% chlorine content with the bulk of the products having approximately 40–60% chlorine. Chlorinated paraffins with a higher chlorine content have higher viscosities and specific gravities.

Chloroinated paraffins are relatively inert materials and have been classed as non-toxic compounds by ingestion or by dermal application, and are not eye irritants in accordance with the procedure specificed in the Regulation Hazardous Labeling Act. Chlorinated parrafins have been used in the metal working industry as an extreme pressure additive in various fluids. Chlorinated paraffins are miscible with many organic solvents and are compatible with a wide variety of oils to provide extreme pressure activity and to act as a boundary lubricant. In general, lower viscosity chlorinated paraffins are desirable for extreme pressure lubrication, while higher viscosity chlorinated paraffins are desirable for boundary lubrication.

Lubricants for motors normally are formulated with additives to improve their lubricating lifetimes and their ability to lubricate an operating motor. Alone, petroleum lubricants and synthetic lubricants, such as silicone, provide a certain level of lubrication. The addition of certain addivities helps to increase the wear properties of the lubricants. Many of these additivies can be added to the lubricant or to the motor. However, the friction and wear reducing properties of base lubricants and lubricants comprising additives still can be further optimized.

Automotive friction reducing compositions comprising chlorinated paraffins also are known in the art. One such composition is disclosed in the United States Patent to Clarke, U.S. Pat. No. 4,534,873, which comprises a hydrocarbon oil; an additive comprising potassium borate, antimony dialkylphosphorodithioate, and a liquid chlorinated paraffin; an alkaline additive, such as a sulfanate; and a viscosity index improver, such as a copolymer. The preferred composition disclosed in the Clarke patent also comprises an anti-oxidant and an anti-foaming agent. The additive composition disclosed in the Clarke patent comprises from 2 to 35% chlorinated paraffins, preferably 12.5%, from 0 to 20% antioxidants, preferably 2.1%, and the remainder the other components previously mentioned. The added composition then is added to engine oil at a level of about 3 to 12% by volume.

The additive composition disclosed in the Clarke patent comprises a number of lubricating and anti-wear components. The hydrocarbon oil preferred is a premium quality, highly refined oil of lubricating viscosity. The anti-wear additive comprises a borate lubricating oil comprising microspheres of inorganic borate which form a resiliant film under extreme pressure conditions between the metal load-bearing surfaces. Likewise, the antimony dy dialkylphosphorodithioate is a metal-based lubricant which, however, is of high toxicity. The chlorinated paraffin constitutes approximately 12.5% by volume of the total additive composition, and about 0.14 to.about 2.5% by volume of the additive-containing motor oil. An alkaline is included to neutralize any hydrochloride acid produced during the operation of the engine and, specifically to neutralize any hydrochloric acid produced by the chlorinated paraffin. A viscosity index improver is added to increase the viscosity of the additive composition. Additionally, an optional anti-oxidant and anti-foaming are included in the additive composition.

The friction reducing composition disclosed in the Clarke patent comprises a relatively large number of ingredients of the lubricating and anti-wear classes, all of which provide lubrication and all of which add to the material cost and production cost of the composition. Further, the friction reducing compound disclosed in Clarke is formulated specifically for use as a lubricating oil for internal combustion engines. Thus, a void is left for a friction reducing composition and lubricant which has a minimal number of components and is applicable for motors of the non-automotive and non-internal combustion type.

An extreme pressure additive for use in metal lubrication is disclosed in the United States Patent to Sloan, U.S. Pat. No. 4,844,825. The additive disclosed in the Sloan patent preferably comprises 30 to 70% chlorinated paraffins, preferably 51.5%, 30 to 70% mineral oil, mineral spirits or aromatic solvents, preferably 31%, and 5 to 10% calcium sulfonate. The preferred composition disclosed in the Sloan patent comprises 51.1% chlorinated paraffins, 31% aromatic solvent, 15.5% mineral oil, 1% calcium sulfate, and 1% mineral spirits. This additive is then added to 10 to 30 parts standard motor oil, preferably 20 parts.

The additive disclosed in the Sloan patent blends the chlorinated paraffin with the mineral oil, which is a liquid petroleum derivative that acts as an additional lubricant. Calcium sulfonate mixed separately with the mineral spirits is added to the chlorinated paraffin/mineral oil to produce the base additive. The calcium sulfonate is included to neutralize any hydrochloric acid created from decomposition of the chlorinated paraffin. A solvent is added to improve the shelf life of the product by thinning the mixture so that the paraffin remains in suspension for a longer period of time. Similar to the composition disclosed in the Clarke patent, the additive disclosed in the Sloan patent comprises a comparatively large number of components which add to the material cost and production cost of the final composition. Likewise, the composition disclosed in the Sloan patent is an oil-based composition suitable for limited use. Thus, there exists a need for a friction reducing composition and lubricant which is not oil-based, comprises fewer components so as to be more economical to manufacture, and is applicable to many different types of motors.

A hydraulic fluid composition for use as a hydraulic fluid, especially under conditions where the avoidance of fire hazards is important is disclosed in the United Kingdom Patent to Earp et al., U.K. Pat. No. 1,413,105. The fluid disclosed in the Earp patent preferably comprises up to about 90% chlorinated normal paraffin, up to about 10% of a rust-inhibitor, up to about 1% of a detergent or dispersent, up to about 2.5% of a heat stabilizing compound, and up to about 2% of a secondary lubricant such as a long-chain fatty acid.

The fluid disclosed in the Earp patent is suitable for use as a hydraulic fluid, that is a fluid which transfters mechanical energy, useful in situations where fire resistence is needed. The inclusion of a secondary lubricating composition indicates the nature of the formulation of the Earp composition, namely not specifically formulated to be a lubricating composition. Thus, the Earp composition does not fill the need for a unitary friction reducing composition suitable for macro engines, such as automotive engines, and micro engines, such as those for use in electronic and computer applications.

Recently, phosphite amine lubricant additives have been developed as extreme pressure additives to replace chlorinated paraffin additives. In the United States patent to Brannon et al., U.S. Pat. No. 4,965,002, a lubricant additive is disclosed which is the reaction product of an alkoxylated amine and a phosphite. The additive disclosed in the Brannon et al. patent represents one recent trend in producing lubricant additives alternative to those containing chlorinated paraffins. Thus, there is a need and desire for friction reducing compounds and lubricants alternative to those containing chlorinated paraffins. However, as certain chlorinated substances achieve significant anti-wear and anti-friction results, the use of chlorinated substances still is desirable.

BRIEF SUMMARY OF THE INVENTION

The present invention satisfies the need for a friction reducing composition and lubricant which is simple in composition and, thus, simple and economical to manufacture, yet still retains the anti-wear and anti-friction characteristics of certain chlorinated substances. The present invention is a family of metal treatment products comprising specific amounts of corrosion inhibitors and, optionally, antimicrobials, added to various chlorinated compounds which, when used alone or in combination with known lubricants, improves the performance and lifetime of a motor. The family of metal treatment products include products formulated for various motor types, such as internal combustion engines, electric motors, electronic equipment, and related gears and equipment and, when blended with conventional lubricants, results in a reduction of friction and friction-related heat of up to 500% or more.

According to a first embodiment of this invention, a friction reducing composition comprising a chlorinated paraffin, having a 57% chlorine content and an SUS of 65 at 210° F, and an antimicrobial compound is produced which, when added to approximately 15 parts of oil, can be used for various motors, such as heart pumps and sealed units. According to a second embodiment of the invention, a friction reducing composition comprising a chlorinated paraffin, having a chlorine content of approximately 50% and an SUS at 210° F. of approximately 45, and a rust inhibiting compound is produced. This second formulation, when added to approximately to 15 parts oil, is useful as an automotive engine additive. According to a third embodiment of the invention, a friction reducing composition comprising a chlorinated paraffin, having a chlorine content of approximately 44% and an SUS at 210° F. of approximately 200, and a rust inhibiting compound is produced. This third formulation, when combined with approximately 10 parts of silicone or other grease, provides a viscous, friction reducing compound suitable for use on gears, and other equipment requiring a high viscosity lubricant.

Accordingly, it is an object of the present invention to provide a friction reducing composition which increases the anti-wear and anti-friction characteristics of conventional lubricants.

It is another object of the present invention to provide a friction reducing composition which will reduce wear on and friction between metal-to-metal contact surfaces.

A further object of the present invention is to provide a friction reducing composition which will reduce the amount of contaminants in a lubricant caused by metal-to-metal contact.

Yet another object of the present invention is to provide a friction reducing composition which increases the fuel efficiency of an automotive engine.

Another object of the present inention is to provide a friction reducing composition which increases the efficiency of motors.

Yet another object of the present invention is to provide a friction reducing composition which can be used in connection with internal combustion engines, transmissions, differentials, and gear boxes.

It is an object of the present invention to provide a friction reducing composition which can be used in connection with electric motors, drum gears, transfer cases, and related equipment.

Another object of the present invention is to provide a friction reducing composition which can be used in connection with electronic equipment and small motor devices requiring special low viscosity lubricants.

A final object of the present invention is to provide a friction reducing composition which is more econonmical to manufacture and simpler in composition than the prior art friction reducing composition.

These objects and other objects, features and advantages will become readily apparent to those skilled in the art when the following detailed description of the preferred embodiments is read in conjuncton with the attached figures.

DETAILED DESCRIPTION OF THE PREFERRED EMBODIMENTS

Figure 1:
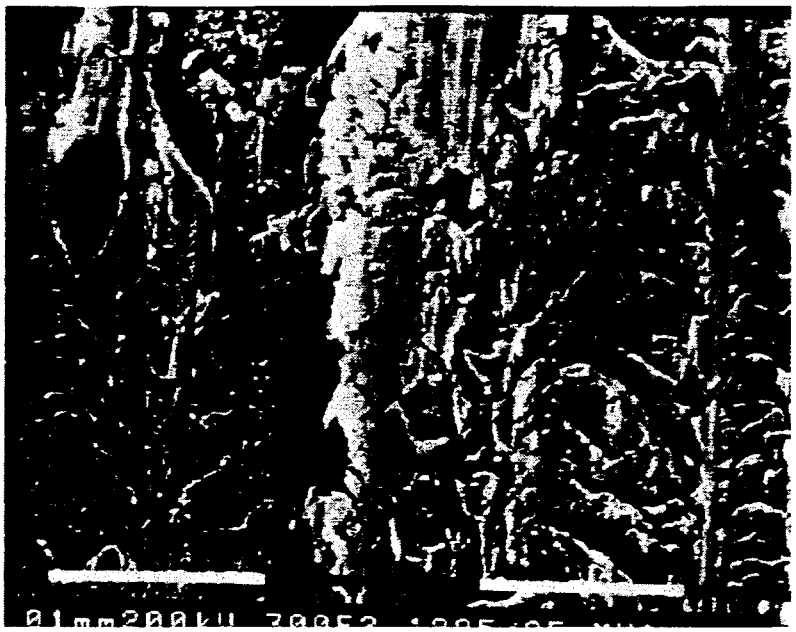
FIG. 1 is a micrograph taken at 300 times magnification of a bearing subjected to a lubricity test using the prior art Slick-50® product.

The preferred form of chlorinated paraffin used in the present invention is the product marketed under the trade name Chlorowax® produced by OxyChem of Deer Park, Texas. Three different chlorinated paraffins are preferred in the three different embodiments. In the first embodiment, Formula 1, Chlorowax® 57-60 chlorinated paraffin is preferred; in the second embodiment, Formula 2, Chlorowax® 50-45-20 chlorinated paraffin is preferred; and in the third embodiment, Formula 3, Chlorowax® G44-200 chlorinated paraffin is preferred. The characteristics of these three chlorinated paraffins are given in Table I. These and other characteristics for the Chlorowax® products can be obtained from specification sheets for the chlorinated paraffins available from OxyChem of Deer Park, Texas as of the date of filing of this Specification.

TABLE I

CHLORINATED PARAFFIN CHARACTERISTICS

| Characteristics | Chlorowax® 57-60 | Chlorowax® 50-45-20 | Chlorowax® G44-200 |
|---|---|---|---|
| Chlorine Content (%) | 57 | 50 | 44 |
| SUS (100° F.) | 1,800 | | |
| SUS (210° F.) | 65 | 45 | 200 |
| Stokes (25° C.) | 15 | | |
| Poise (25° C.) | 20 | 125 | |
| Specific Gravity (25°/25° C.) | 1.32 | 1.23 | |
| Stability (% HCl, 4 hrs. @ 175° C.) | 0.25 | | |

The various other chlorinated paraffins can be substituted for the preferred chlorinated paraffins of this invention. The composition ranges, preferred composition ranges, and preferred compositions for Formula 1, Formula 2, and Formula 3 are given in Tables II, III and IV.

TABLE II

COMPOSITION RANGES

| Component (Vol. %) | Formula 1 | Formula 2 | Formula 3 |
|---|---|---|---|
| Chlorinated Paraffin | 75-98[a] | 75-98[b] | 75-98[c] |
| Rust-Inhibitor | 2-25 | 2-25 | 2-25 |
| Antimicrobial | 0-0.01 | 0-0.01 | 0-0.01 |

TABLE III

PREFERRED COMPOSITION RANGES

| Component (Vol. %) | Formula 1 | Formula 2 | Formula 3 |
|---|---|---|---|
| Chlorinated Paraffin | 90-98[a] | 90-98[b] | 90-98[c] |
| Rust-Inhibitor | 2-10 | 2-10 | 2-10 |
| Antimicrobial | 0-0.005 | 0-0.001 | 0-0.001 |

TABLE IV

PREFERRED COMPOSITION

| Component (Vol. %) | Formula 1 | Formula 2 | Formula 3 |
|---|---|---|---|
| Chlorinated Paraffin | 95[a] | 95[b] | 95[c] |
| Rust-Inhibitor | 5 | 5 | 5 |
| Antimicrobial | 0.001 | 0 | 0 |

[a]Chlorowax® 57-60 (OxyChem)
[b]Chlorowax® 50-45-20 (OxyChem)
[c]Chlorowax® G44-200 (OxyChem)

When choosing the appropriate chlorinated paraffin, the application for which the friction reducing composition is to be used must be kept in mind such that the appropriate chlorinated paraffin is selected. The characteristics of various chlorinated paraffins can be found on pages 574-575 of the 1991 Modern Plastics Mid-October Encyclopedia issue of the 1991 edition of the Modern Plastics Encyclopedia, which is incorporated herein by this reference. Preferably the preferred chlorinated paraffin has from 10 to 30 carbon atoms in the chain and comprises from 40% to 70% chlorine. The chlorinated paraffin also comprises an additive to increase heat stability, such as epoxidated soya oil. Typically, about six percent (6%) by weight of the heat stabilizer, based on the weight of the chlorinated paraffin, is used.

Alternatively, various other chlorinated compounds can be used in placed of chlorinated paraffins. For example, chlorinated polyethylene and chlorinated PVC can be used. A discussion of chlorinated polyethylene can be found in volume 6 of the Encyclopedia of Polymer Science, page 494, which is incorporated herein by reference. A discussion of chlorinated PVC can be found in volume 17 of the Encyclopedia of Polymer Science, page 327, which is incorporated herein by reference.

The preferred rust-inhibiting compound is an antioxidant such as Exchlor SC an antioxidant compound. Alternatively, other rust-inhibiting compounds which are equivalent to the preferred compound may be substituted. Such alternative rust-inhibiting compounds include substituted phenol or polyphenols, long-chain saturated or unsaturated di- or tri-carboxylic acids containing one or more alkyl chain. The rust-inhibiting compound helps prevent rust and other oxidations from forming when the present invention contacts the metal engine surfaces, and helps prevent the chlorinated paraffins from oxidizing. The formation of rust, as is known to one skilled in the art, reduces engine material strength and increases friction, both of which are undesirable.

The preferred antimicrobial is Microban 2. Alternatively, other antimicrobial compounds which are equivalent to the preferred antimicrobial compound can be used. Such alternative antimicrobial compounds include triazine compounds, phenyl compounds such as phenyl mercuric nitrate and phenylphenol; alkyl amine oxides and chlorides such as dimethylstearylamine oxide, dipropyldodecylamine oxide, and alkyl dimethylethylbenzyl ammomium chloride; morphorline compounds; thiazolin; pyrimidine compounds; and other more conunon antimicrobials such as oxine, chlorobutrol, bacitracin, chlorocresol, actinomycin, benzalkoniun chloride, and carbenicillin. The use of an antimicrobial compound is especially desirable in motors used in electronic devices, such as those motors used in computer equipment, as the presence of microbes may affect adverstely the high prescion of such motors.

The components are blended together to form the friction reducing compound of the present invention. The blending is preferably conducted so as to minimize foaming, separation and/or contamination. The blending is performed between 50° F. and 212° F., and preferably is performed at between 150° F. and 200° F. Although blending at temperatures lower than 50° F. and higher than 212° F. is possible under certain circumstances, it is less desirable, as certain constituents may be too viscous at lower temperatures, or may boil at higher temperatures. The result of the final blending is the friction reducing composition of the invention. Typically, the chlorinated paraffin is preblended with up to 10% by weight of epoxidated soya oil or jojoba oil. The anti-corrosive (rust-inhibiting) compound next is blended into the chlorinated paraffin-soya (or jojoba) blend to complete the formula. Overall, no special sequence of blending is necessary, the above sequence merely is typical.

The various friction reducing compositions produced, designated as Formula 1, Formula 2 and Formula 3, then can be added to any conventional lubricant. Formula 1 preferably is added to 10 to 20 parts conventional oil, preferably 15 parts conventional oil, to produce the friction reducing lubricant. The conventional oil is chosen for the specific purpose of the friction reducing lubricant. For example, for internal combustion engine uses, a conventional petroleum oil can be used. For high speed, sealed motors to be used in electronics applications, a silicone oil may be more appropriate.

Formula 2 also may be added to the conventional oils discussed in conjunction with Formula 1.

Formula 3 was developed for high viscosity lubricant situations. For example, Formula 3 can be added to 5-15 parts, preferably 9 parts, high viscosity lubricant, such as silicone or grease. The lubricant produced using Formula 3 is suitable for applications involving grease, such as open gears, bearings and the like.

Additional ingredients may be added to the Formulas for specific applications. For example, for high speed or high revolutions per time unit motors, a thinner lubricant may be required. For such applications, the present invention, preferably Formula 1, may be altered by adding a solvent, preferably a lubricating solvent. Typically, any hydrocarbon solvent may be used which will thin the chlorinated paraffins. The NORPAR® hydrocarbon solvents produced by Exxon Chemical Company of Houston, Tex., consisting essentially of linear (normal) paraffins, have proved suitable. These solvents also exhibit certain lubricating qualities of their own.

The addition of a solvent will produce a formula of lower viscosity. For high speed, sealed motors, high precision motors, and motors used in highly sterile applications, a thinner formula may be desirable. The NORPAR® solvents comply with certain FDA requirements for use in food-related applications, and the present invention, thinned with a solvent such as a NORPAR® solvent, is useful in medical and food-related applications, such as heart pumps and the like.

The effectiveness of the formulas as friction reducing compositions can be demonstrated using a conventional extreme pressure testing machine in which a stationary steel bearing is brought into contact with a rotating bearing. The lower portion of the rotating bearing sits in a bath of the material to be tested, in this case either the friction reducing compound of the present invention or a standard lubricating compound such as oil. The rotation of the bearing allows the bearing to be coated with the applicable compound. The stationary bearing is brought in contact with the rotating bearing, typically by a lever arm. Friction is created at the contact point between the stationary bearing and the rotating bearing. Various weights are added to the lever arm such that various pressures are created between the stationary bearing and the rotating bearing, creating friction between the stationary bearing and the rotating bearing.

Two types of tests generally are conducted: an equal weight comparison test; and a failure test. In the equal weight comparison test, equal weights are applied to the lever arm when testing the friction reducing composition against a standard lubricating compound. The same weight is applied to the bearing lubricated by the standard compound and to the friction reducing compound for an equal amount of time. The rotating bearings are removed and the wear results are compared. The failure test involves a method similar to the equal weight comparison test. Weights are added continuously to the lever arm until the rotating bearings ceases to rotate because the coefficient of friction is reached. The cessation of rotation represents the seizing of an engine.

The lubricating ability of the present invention was compared to the lubricating ability of various commercially available lubricating compounds. The five commercially available compounds which were compared to the formula of the present invention were: Slick-50®; Pro-Long, which is covered by U.S. Pat. No. 4,844,825; Petron-Plus, which is covered by U.S. Pat. No. 4,534,873; Militec, which currently has a patent pending status; and common 20W50 motor oil. Lubricity tests were conducted on a Falex lubricity test machine using a Timken roller bearing and race. All five commercially available products were blended in motor oil at the exact proportion recommended by their respective manufacturers. Using the failure test discussed above, two consecutive pulls were made on specimens coated with each commercially available product. The results of such pulls are shown below in Table V.

TABLE V

COMPARATIVE LUBRICITY TESTING

| Product | Pull | Seconds | Pounds | FIG. # |
|---|---|---|---|---|
| Slick-50 | 1 | 6 | 6.25 | 1 |
| | 2 | 5 | 7.5 | |
| Pro-Long | 1 | 5 | 9 | 2 |
| | 2 | 10 | 13.75 | |
| Petron-Plus | 1 | 5 | 7 | 3 |
| | 2 | 9 | 13.5 | |
| Militec | 1 | 6 | 9 | 4 |
| | 2 | 9 | 14.25 | |
| Present Invention | 1 | 12 | 30* | 5 |
| | 2 | 13 | 30* | |
| 20W50 Oil | 1 | 6 | 6.50 | 6 |
| | 2 | 6 | 7 | |

*no stall/failure - machine still running smoothly

Figure 7:
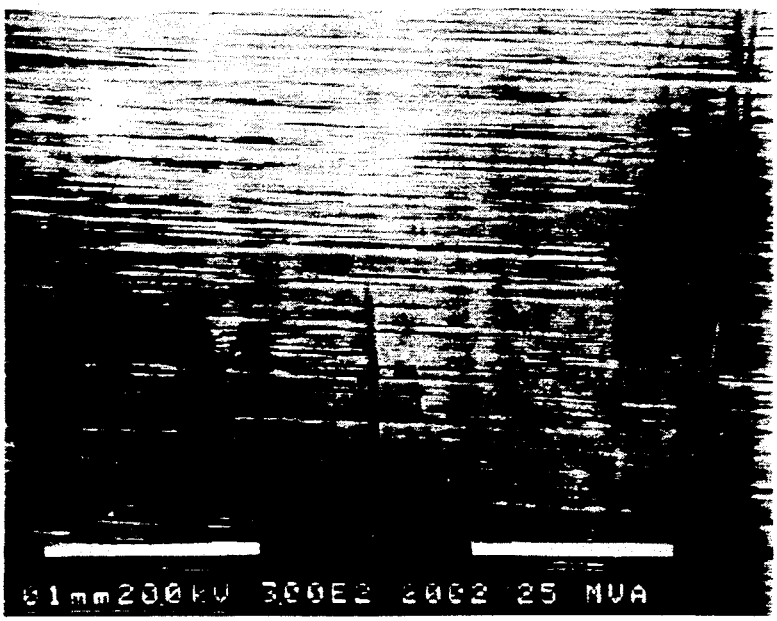
FIG. 7 is a micrograph taken at 300 times magnification of a new bearing surface.
Figure 6:
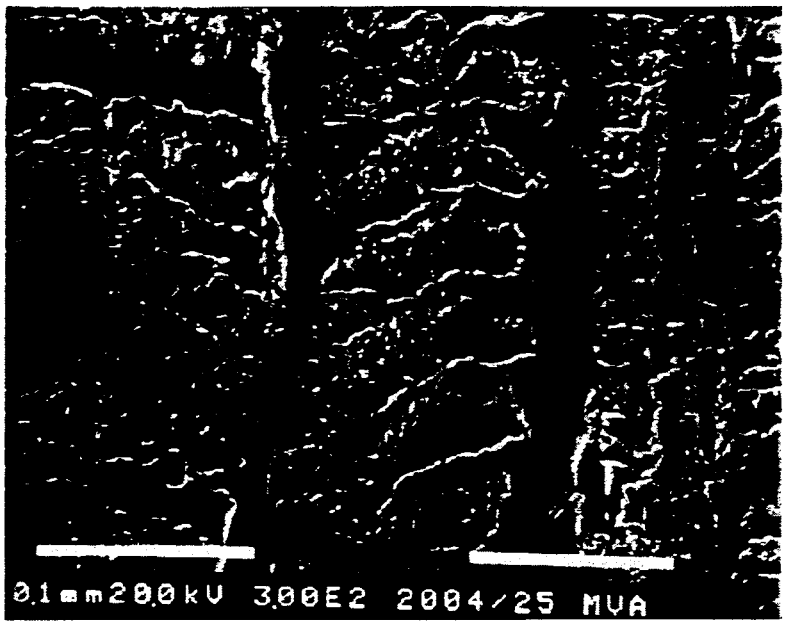
FIG. 6 is a micrograph taken at 300 times magnification of a bearing subjected to a lubricity test using standard 20W50 motor oil.

FIGS. 1-6 represent the results of the lubricity tests of the commercially available products and the present invention. FIG. 7 is a micrograph of a new bearing surface prior to subjection to a lubricity test. Each of the micrographs in FIGS. 1-7 were taken at 300 magnification On a Phillips 525 Automated Scanning Electron Microscope with full electron microprobe capabilities through energy dispersive x-ray spectrometry, including light element detection via a windowless EDS detector, and back scattered capacity. FIGS. 1-6 show the results of both pulls; the second pull was conducted at the same place on the bearing as the first pull.

Figure 2:
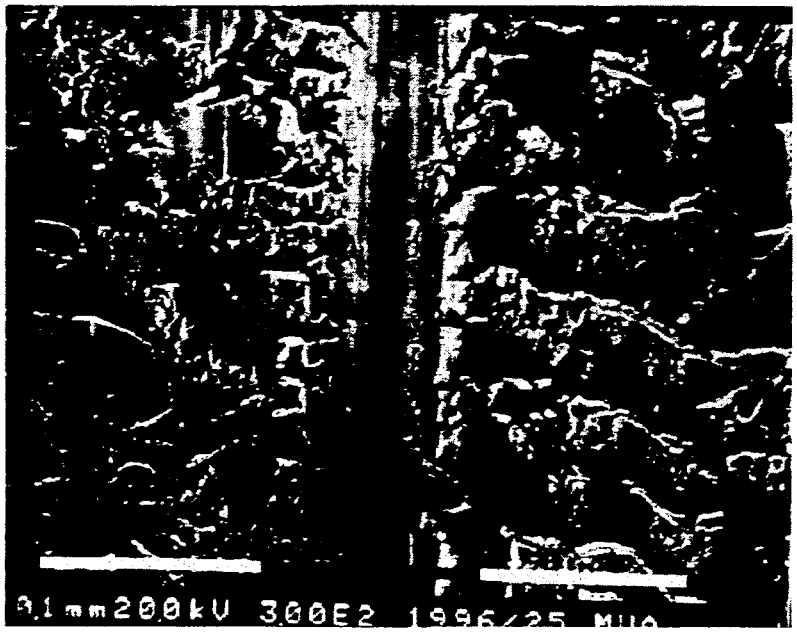
FIG. 2 is a micrograph taken at 300 times magnification of a bearing subjected to a lubricity test using the prior art product Pro-Long.
Figure 3:
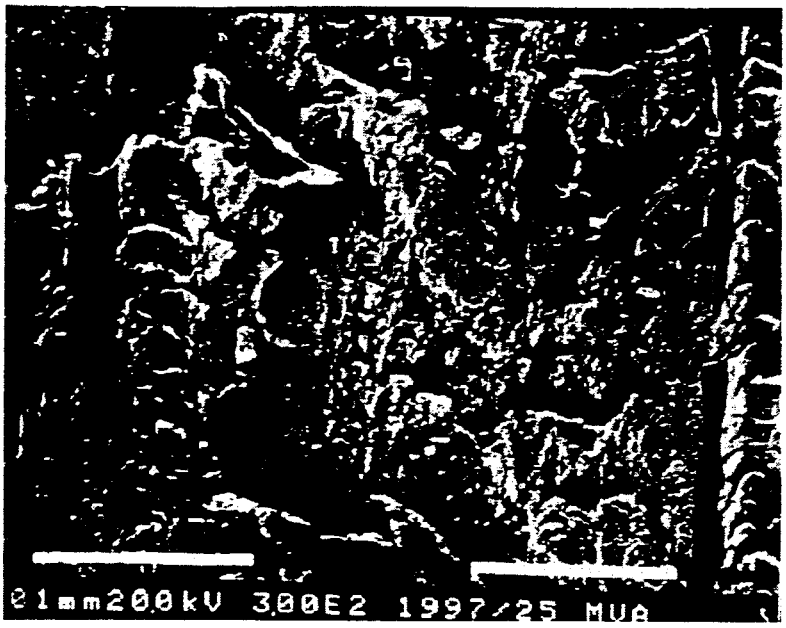
FIG. 3 is a micrograph taken at 300 times magnification of a bearing subjected to a lubricity test using the prior art product Petron-Plus.
Figure 4:
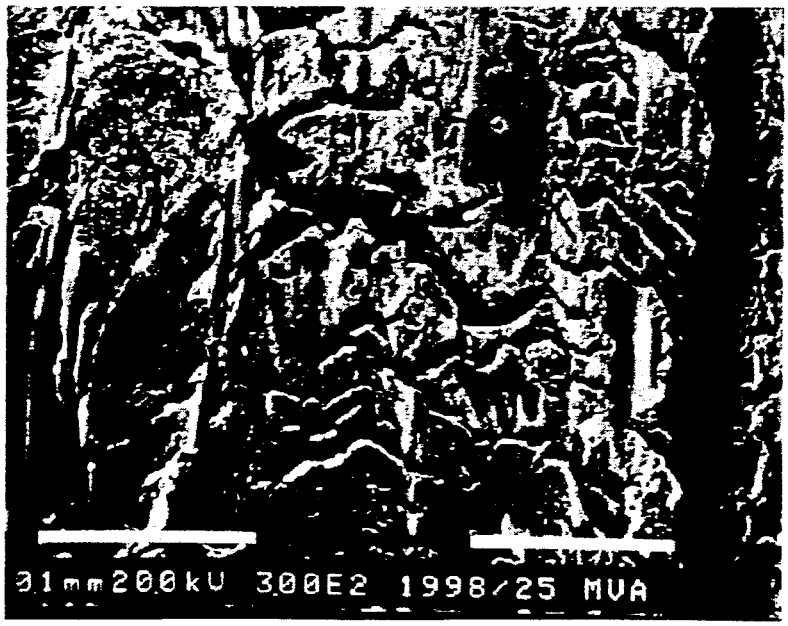
FIG. 4 is a micrograph taken at 300 times magnification of a bearing subjected to a lubricity test using the prior art product Militec.
Figure 5:
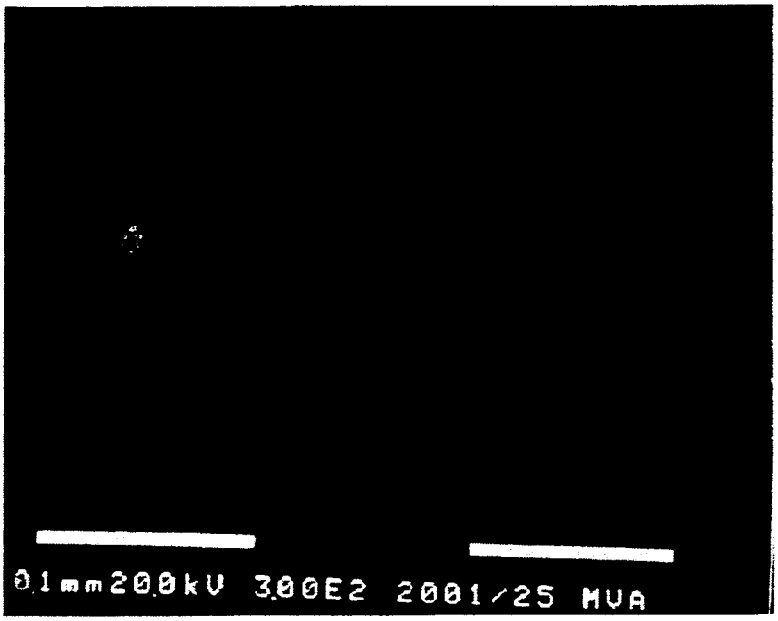
FIG. 5 is a micrograph taken at 300 times magnification of a bearing subjected to a lubricity test using the formula of the present invention.
Figure 8:
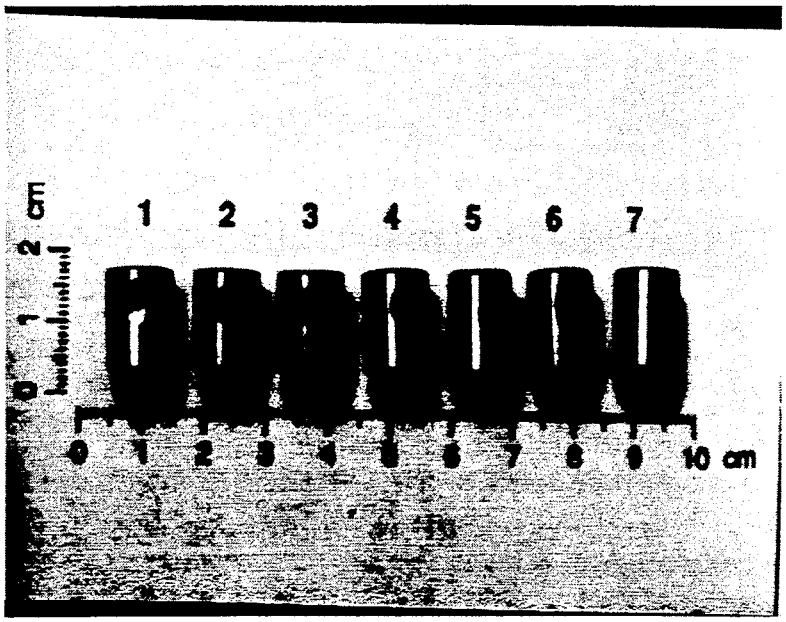
FIG. 8 is a photograph of the bearings shown in FIGS. 1-7 for comparison purposes.

As can be seen, from Table V and FIGS. 1–4 and 6, when the commercially available prior art products are used, stall/failure and significant bearing destruction occurs. As set forth in Table V, each of the commercially available prior art products did not prevent stall-/failure on the lubricity machine, with the highest lubricity achieved by the Pro-Long and Militec products. However, as can be seen in FIGS. 2 and 4, the use of the Pro-Long and Militec products, respectively, did not prevent significant damage the bearing surface. On the contrary, when the present formula was used in the lubricity machine, 30 lbs. was applied for 13 seconds and stall/failure still did not occur. Further, as can be seen from FIGS. 5 and 8, significant bearing damage did not occur. In fact, the bearing surface after subjected to the lubricity test using the present formula was more uniform than the new bearing surface before lubricity testing as shown in FIG. 7. FIG. 8 shows a side-by-side comparison of the bearings used in the lubricity test, with the number above each bearing corresponding to the respective FIG. number.

The friction reducing compound of Formula 1 also has been tested in internal combustion engines. Formula 1 was added to Shell® 15W40 weight diesel engine oil and was run in a Cummins diesel engine. Results were compared to the same engine running on Shell® 15W40 weight diesel engine oil alone. The results of this test are shown in Table VI. As can be seen, the additive did not materially effective the SUS viscosity or the SAE grade. However, when diesel oil alone was run for 16,000 miles was compared to diesel oil containing the friction reducing composition of Formula 1 run for 14,000 miles, significant reductions in solids volume, and chromium, iron, tin, and silica contaminants, was observed. For example, the diesel oil alone had almost 12 times the volume of solids compared to the diesel oil containing the friction reducing composition. Likewise, the diesel oil alone contained six times the volume of chromium, almost six times the volume of iron, three and one-half times the volume of tin and six times the volume of silica when compared to the diesel oil containing the friction reducing composition of the present invention. This comparison shows that the friction reducing composition of the present invention contains significant anti-wear and anti-friction characteristics.

TABLE VI

COMPARATIVE TESTING IN ENGINES

| | WITHOUT ADDITIVE | | WITH ADDITIVE |
|---|---|---|---|
| Drain Hrs/Mi | 16,000 | 7,1000 | 14,000 |
| Oil Added, quarts | 3 | 4 | 0 |
| Viscosity SUS 210° F. | 65 | 63 | 62 |
| SAE Grade 210° F. | 30 | 30 | 30 |
| Solids % Volume | 14.0 | 3.5 | 1.2 |
| Total Base Number | 3.2 | 4.9 | 4.6 |
| Water | N | N | N |
| Fuel Dilution | N | N | N |
| Anti-Freeze | N | N | N |
| Chromium | 6 | 0 | 1 |
| Copper | 5 | 3 | 4 |
| Iron | 97 | 77 | 17 |
| Lead | 9 | 6 | 5 |
| Tin | 14 | 8 | 4 |
| Aluminum | 3 | 8 | 3 |
| Silica (dirt) | 6 | 8 | 1 |
| Boron | 0 | 0 | 0 |
| Sodium | 0 | 0 | 0 |

Comparative testing also was carried out to document the increased fuel efficiency achieved using the friction reducing compositions of the present invention. As shown in Tables VII and VIII, identical engines ran more efficiently when oil containing the friction reducing composition of the present invention was used in place of standard oil alone. For gasoline passenger automobile engines, ranging from a four cylinder Toyota engine to a 350 cubic inch GMC engine, the average fuel efficiency increase was 21.3%. For diesel truck engines, the average fuel efficiency increased was 13.6%. These data show the increase efficiency which can be achieved when adding the friction reducing composition to standard engine oil.

TABLE VII

GASOLINE PASSENGER AUTOS

| | Miles Per Gallon | | | |
|---|---|---|---|---|
| | Before | After | Increase | Percent |
| 350 GMC | 18.0 | 21.6 | 3.6 | 20.0% |
| 4.2 GMC | 17.0 | 20.4 | 3.4 | 20.0% |
| 305 Ford | 14.0 | 16.8 | 2.8 | 20.0% |
| 4.0 Jeep | 22.0 | 26.4 | 4.4 | 20.0% |
| 2.5 Jeep | 22.0 | 26.6 | 4.6 | 20.9% |
| 4 cyl Celica | 28.0 | 35.0 | 7.0 | 25.0% |
| Average | 20.2 | 24.5 | 4.3 | 21.3% |

TABLE VIII

DIESEL TRUCK ENGINES

| | Miles Per Gallon | | | |
|---|---|---|---|---|
| Engine Type | Before | After | Increase | Percent |
| Cummins/Kenworth | 4.5 | 5.0 | 0.5 | 11.1% |
| Cat/Mac | 5.3 | 6.0 | 0.7 | 12.6% |
| Cummins/Peterbilt | 5.5 | 6.3 | 0.8 | 14.9% |
| Cat/Peterbilt | 6.0 | 6.9 | 0.9 | 15.0% |
| Average | 5.3 | 6.0 | 0.7 | 13.6% |

The above descriptions, embodiments and examples, are offered for illustrative purposes only, and are not intended to limit the invention of the present application which is defined in the appended claims.

What is claimed is:

1. A friction reducing composition consisting essentially of;

(a) between 75 and 98 volume percent of a chlorinated hydrocarbon selected from the group consisting of chlorinated paraffins, chlorinated polyvinyl chlorides and chlorinated polyethylenes;

(b) between 2 and 25 volume percent of a rust-inhibiting compound selected from the group consisting of compounds which inhibit the corrosion of chlorinated paraffins substituted phenol or polyphenol, and long-chain saturated or unsaturated di- or tricarboxylic acids; and (c) up to 0.02 volume percent of an antimicrobial compound.

2. The friction reducing composition described in claim 1, wherein said chlorinated hydrocarbon comprises approximately 90 to 98 volume percent of said friction reducing composition.

3. The friction reducing composition described in claim 2, wherein said rust-inhibiting compound comprises approximately 2 to 10 volume percent of said friction reducing composition.

4. The friction reducing composition described in claim 1, wherein said antimicrobial compound is selected from the group consisting of trichlorophenol, triazine compounds; phenyl compounds; alkyl amine oxides and chlorides morphorline compounds; thiazolin; pyrimidine compounds; oxine; chlorobutrol; bacitracin; chlorocresol; actinomycin; benzalkoniun chloride; and carbenicillin.

5. A friction reducing composition comprising:

(a) approximately 95 volume percent of a chlorinated hydrocarbon selected from the group consisting of chlorinated paraffins, chlorinated polyvinyl chlorides, and chlorinated polyethylenes; and (b) approximately 5 volume percent of a rust-inhibiting compound selected from the group consisting of compounds which inhibit the corrosion of chlorinated paraffins phenols and polyphenols.

6. The friction reducing composition described in claim 5, further comprising approximately 0.01 volume percent of an antimicrobial.

7. The friction reducing composition described in claim 6, wherein said antimicrobial compound is selected from the group consisting of trichlorophenol and triazines.

8. The friction reducing composition described in claim 7, wherein said chlorinated hydrocarbon is a chlorinated paraffin having a chlorine content of between 35 and 75 volume percent.

9. The friction reducing composition as described in claim 8, wherein said chlorinated paraffin has a chlorine content of between 40 and 70 percent.

10. A lubricant comprising:

(a) one part by volume of the friction reducing composition of claim 1; and (b) 5 to 35 parts by volume of a liquid lubricant.

11. A lubricant comprising:

(a) 1 part by volume of the friction reducing composition of claim 5; and (b) 5 to 35 parts by volume of a liquid lubricant.

12. A lubricant comprising:

(a) 1 part by volume of the friction reducing composition of claim 9; and (b) 5 to 35 parts by volume of a liquid lubricant.

* * * * *